US011052296B2

(12) United States Patent
Shannon

(10) Patent No.: US 11,052,296 B2
(45) Date of Patent: Jul. 6, 2021

(54) GYMNASIUM GAME WITH PROJECTILES, MOVABLE TARGET, AND TWO TEAMS

(71) Applicant: Michael Shannon, Whitestone, NY (US)

(72) Inventor: Michael Shannon, Whitestone, NY (US)

( * ) Notice: Subject to any disclaimer, the term of this patent is extended or adjusted under 35 U.S.C. 154(b) by 0 days.

(21) Appl. No.: 16/440,240

(22) Filed: Jun. 13, 2019

(65) Prior Publication Data

US 2019/0388751 A1 Dec. 26, 2019

Related U.S. Application Data

(63) Continuation-in-part of application No. 16/017,178, filed on Jun. 25, 2018, now abandoned.

(51) Int. Cl.

| | |
|---|---|
| ***A63B 63/06*** | (2006.01) |
| ***A63B 67/06*** | (2006.01) |
| ***A63B 67/00*** | (2006.01) |

(52) U.S. Cl.

CPC ..... *A63B 63/06* (2013.01); *A63B 67/002* (2013.01); *A63B 67/06* (2013.01); *A63B 2067/061* (2013.01)

(58) Field of Classification Search

CPC ..... A63B 67/02; A63B 63/00; A63B 67/06; A63F 7/06; A63F 7/0604

USPC .... 473/471, 588; 273/108–129 W, 398–402; 446/279–289

See application file for complete search history.

(56) References Cited

U.S. PATENT DOCUMENTS

| | | | | | |
|---|---|---|---|---|---|
| 1,489,701 | A * | 4/1924 | Geiser | A63G 25/00 | 180/2.1 |
| 2,269,941 | A * | 1/1942 | Jones | A63B 67/00 | 273/126 R |
| 2,366,782 | A * | 1/1945 | Gorsuch | A63B 67/002 | 273/127 B |
| 3,393,913 | A * | 7/1968 | Safina | A63B 67/00 | 273/118 R |
| 3,656,753 | A * | 4/1972 | Juneau | A63F 7/06 | 273/122 R |
| 3,822,499 | A * | 7/1974 | De Vos | A63H 33/108 | 446/121 |
| 4,060,245 | A * | 11/1977 | Gamez Duch | A63F 7/0668 | 273/108.5 |
| 4,218,062 | A * | 8/1980 | Brooks, Jr. | A63B 21/0618 | 273/108 |
| 4,244,584 | A * | 1/1981 | Viveiros | A63F 7/305 | 273/108 |
| 4,261,568 | A * | 4/1981 | Such | A63F 7/0668 | 273/108.5 |

(Continued)

*Primary Examiner* — Melba Bumgarner
*Assistant Examiner* — Amir A Klayman
(74) *Attorney, Agent, or Firm* — Alfred M. Walker; Joha F. Vodopia

(57) ABSTRACT

A gymnasium or playing field game apparatus provides one or more movable target components in the shape of a mascot mounted on swivel casters which roll on the gym floor or other playing field. Each component serves as a movable target for projectiles thrown by two teams from geometrically opposite sides. Each mascot is moved incrementally upon being impacted by a projectile to move the mascot on the gym floor until it "breaks through" a designated goal finish line of traffic cones protecting one team or the other.

19 Claims, 9 Drawing Sheets

(56) References Cited

U.S. PATENT DOCUMENTS 4,330,130 A * 5/1982 Carr ..... A63F 9/0204 206/315.1
4,344,628 A * 8/1982 Warehime ..... A63B 63/06 273/127 R
5,145,431 A * 9/1992 Dowdeswell ..... B63C 11/16 359/894
5,259,806 A * 11/1993 Chang ..... A63H 5/00 446/270
5,348,306 A * 9/1994 Strishak ..... A63B 67/06 273/317
5,529,016 A * 6/1996 Lonsway ..... A01K 15/025 119/707
5,735,749 A * 4/1998 Charbel ..... A63D 15/00 473/3
5,941,529 A * 8/1999 Kinsey ..... A63B 63/00 273/401
6,010,416 A * 1/2000 Frederick ..... A63C 19/04 473/490
6,039,327 A * 3/2000 Spector ..... A63G 19/18 280/1.13
6,217,025 B1 * 4/2001 Yamazaki ..... A63F 7/06 273/108.55
6,386,997 B1 * 5/2002 Brown ..... A63B 67/06 273/317
6,598,882 B2 * 7/2003 Stubberfield ..... A63B 67/06 273/317
6,843,478 B1 * 1/2005 Hoepelman ..... A63B 63/00 273/342
7,104,543 B2 * 9/2006 Wilk ..... A63F 3/00697 273/288
7,338,047 B2 * 3/2008 Kelley ..... A63B 67/066 273/118 R
7,360,767 B2 * 4/2008 Merccica ..... A63B 67/06 273/350
7,611,427 B1 * 11/2009 Cline ..... A63B 5/11 473/459
7,670,204 B2 * 3/2010 Huber ..... A63B 43/02 446/34
8,002,283 B1 * 8/2011 Jones ..... A63B 63/00 273/343
8,201,829 B2 * 6/2012 Belete ..... A63B 67/066 273/317
8,282,511 B2 * 10/2012 Fatherree ..... A63B 67/002 273/317
8,409,035 B1 * 4/2013 Guyer ..... A63B 71/02 473/415
8,506,426 B2 * 8/2013 Perez ..... A63B 67/002 473/415
8,932,157 B2 * 1/2015 Wright ..... A63B 69/002 473/470
9,095,770 B2 * 8/2015 Ho ..... A63H 33/04
9,295,889 B2 * 3/2016 Conway ..... A63B 59/20
9,320,953 B2 * 4/2016 Belete ..... A63B 67/066
9,567,135 B1 * 2/2017 Spadaccini ..... A47C 7/62
2004/0160012 A1 * 8/2004 Steiner ..... A63B 63/06 273/405
2004/0235388 A1 * 11/2004 Padilla ..... G09B 1/00 446/269
2007/0213146 A1 * 9/2007 Lagergren ..... A63B 63/00 473/415
2010/0225061 A1 * 9/2010 Bath ..... A63B 43/005 273/348.4
2011/0195805 A1 * 8/2011 Sliger ..... A63B 63/06 473/470
2012/0065004 A1 * 3/2012 Blackwell ..... A63B 71/0669 473/476
2016/0074727 A1 * 3/2016 Nelson ..... A63B 67/002 473/415
2016/0296850 A1 * 10/2016 Scaccia ..... A63H 33/048
2017/0065863 A1 * 3/2017 Washburn ..... A63B 67/002
2017/0259143 A1 * 9/2017 Ramnarine ..... A63B 63/08
2019/0299073 A1 * 10/2019 Vollbrecht ..... A63B 63/06

* cited by examiner

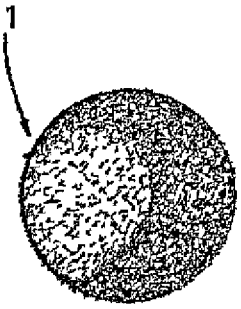
Fig. 5
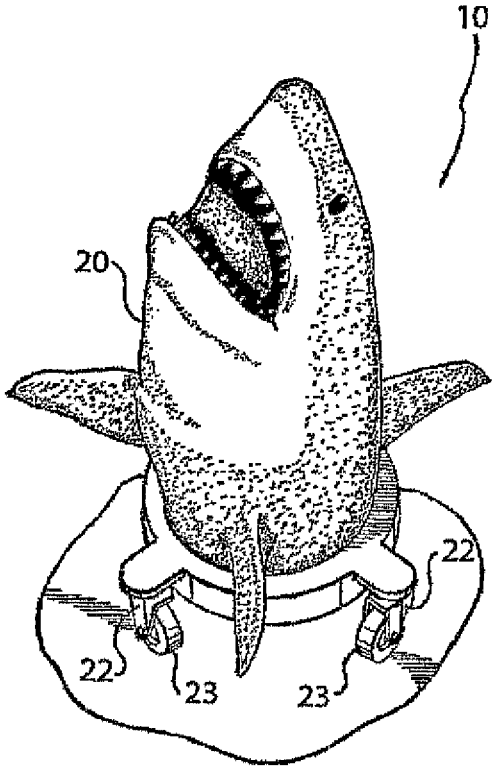
Fig. 6
Fig. 7
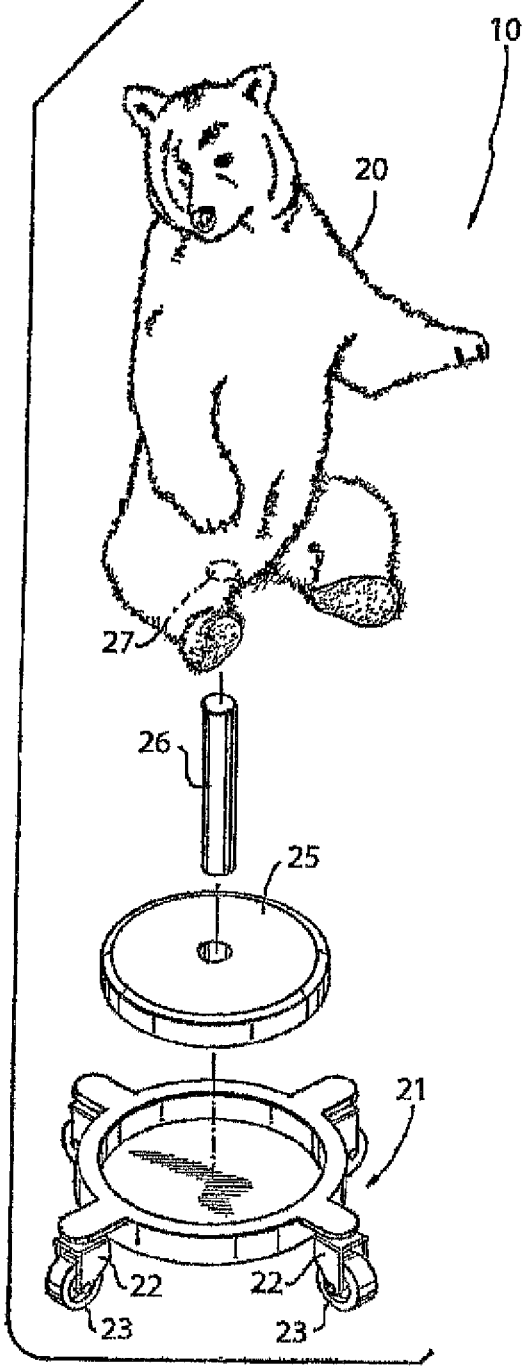

GYMNASIUM GAME WITH PROJECTILES, MOVABLE TARGET, AND TWO TEAMS

RELATED APPLICATIONS

This application is a continuation-in-part of application Ser. No. 16/017,178, filed Jun. 25, 2018, which application is incorporated by reference herein. Applicant claims priority in part therefrom pursuant to 35 U.S.C. § 120.

FIELD OF THE INVENTION

The present invention relates to a gymnasium game with projectiles and a movable target character on caster wheels, which is to be moved forward toward a distinct finish goal line by projectiles thrown by two opposing teams of players.

BACKGROUND OF THE INVENTION

The prior art reveals many patents involving projectiles thrown or hit at stationary objects. The patent of Guyer (U.S. Pat. No. 8,409,035) uses two sets of game balls, two sets of towers of different heights, and ball-striking mallets. One of the objects is to knock over the towers upon impact by a game ball.

The patent of Warehime (4344628) uses a turnstile goal in a fixed location with paddles impacted by projectiles (disks or balls) hurled by opposing teams outside of a circular exclusion zone around the goal. The paddles are turned incrementally upon impact by the projectiles. The turnstile goal is fitted with counters which record clockwise and counterclockwise incremental turns separately. The team accumulating the larger count at the end of the game wins.

Another game with a fixed pivotal target is in pending U.S. Patent Application Publication No. US2004/0160012 A1 of Steiner, whereby players are positioned at opposite sides of a target character, such as the example of a crocodile in drawing FIG. 5 of Steiner '012). A downwardly extending but pivotal planer sub-target piece is pivotal back and forth over a horizontal axis about a fixed, non-movable base. If one player hits one side of the pivotal sub-target piece, pivoting of the piece opens a valve which sprays water toward the opposite player. The pivoting in an opposite direction occurs if the play being sprayed with water happens to hit the opposite side of the pivotal piece, thereby causing the target crocodile to spin about a fixed pivot, and to spray the other player with water.

But the target crocodile in Steiner '012 only pivots about a fixed point, and does not move off of the fixed pivot point.

A non-patent reference entitled the "Water Ball Shooter" on pages 3 and 4 of the "Best Ever Water Games" website, describes briefly a game where "a goal/target is designated on the ground, using a rope. Line up some lightweight balls and use the hose to move/push the balls into the goal using the water."

However, the "Water Ball Shooter" just describes contacting a plurality of balls with a hose's water spray from a spout and does not describe a single target character on caster wheels to be moved forward by balls or other projectiles thrown by two opposing teams.

U.S. Pat. No. 4,218,062 of Brooks discloses a method of propelling a game playing piece on casters in which players use their feet to directly contact and kick around the piece in a game similar to soccer (see Background and summary of the Invention of the Brooks '062 reference). There is no notion in Brooks '062 for a player remotely and manually throwing a projectile against the playing piece in Brooks '062, for remotely advancing the playing piece forward toward a goal line extending the entire length of the playing field, without the player directly and physically touching the playing piece by kicking or otherwise, to move it forward by the direct kicking of the playing piece by the kicking player participant in Brooks '062.

US Patent application publication number 2004/0235388 of Padilla discloses a movable toy, which is in the form of a platform incorporating a small discrete target such as a receptacle, e.g., a bucket, basketball hoop, pylon, or a hockey stick. The reference also mentions that "the present invention may be pushed, pulled, kicked, hit, ridden or otherwise used as a component of a team oriented game" (par. 0030). The only examples shown are platforms to support a child (par. 0033), a target for hand toss games (par. 0040), and for a variety of other games "such as bowling, hockey, and soccer" (par. 0046), so it is not clear about the meaning of the expression "hit." It does not appear that Padilla '388 teaches the use of such a movable toy in a method of playing a gymnasium game wherein the players use projectiles to move the toy across a goal line, as in the present claimed inventive method.

U.S. Pat. No. 8,506,426 of Perez describes a game of "lobol", i.e., "a small, solid ball," in which the lobol is placed on the playing field, and players throw other balls at the lobol to move the lobol into "the goal enclosure" (see Summary of the Invention) and was cited for the use of cones to form a goal. Actually, the reference has a goal which comprises a discrete, limited size goal enclosure with an opening formed by the use of two posts 50 forming a net enclosure 40, as shown in FIG. 1 of Perez, and as described in column 4, lines 15-20 therein.

OBJECTS OF THE INVENTION

A key objective of the gymnasium or playing field game of this invention is to provide one or more movable target components in the shape of a mascot mounted on swivel casters which roll on the gym floor or other playing field. Each component serves as a movable target for projectiles thrown by two teams from geometrically opposite sides. The mascot is moved incrementally upon being impacted by a projectile.

An object of the game is therefore to move a mascot on the gym floor until it "breaks through" a designated goal "finish line" of traffic cones protecting one team or the other.

Other objects which become apparent from the following description of the present invention.

SUMMARY OF THE INVENTION

The game of this invention is designed to be quickly set up or taken down on a gym floor. Except for the target component, all other equipment is readily available and inexpensive. Ideal for elementary school use, it can be played in an area of a standard elementary school basketball court (a rectangular area 74 feet by 42 feet) although the exact size or shape of the game area is not critical. As described above, all versions of this game involve two teams each behind a line marked by traffic cone barriers respectively. The barrier lines are set some distance apart with the starting location of the target being at the center between the barrier lines. Each of the team members hurl projectiles at the target which rides on swivel casters with the objective of incrementally moving it toward the barrier line of the opposing team. A win or score is counted when the target mascot penetrates the barrier line of the opposing team. The goal finish lines extend a substantial length of the playing field instead of being a small goal enclosure, such as a basketball hoop or lacrosse net, and the projectiles are thrown by team players from behind the goal finish lines. In contrast to throwing a projectile into a small enclosure receptacle as in Padilla '388, the present invention teaches the use of such a movable target mascot toy in a method of playing a gymnasium game wherein the players manually throw hand held projectiles, to remotely move the movable target mascot toy across a goal line extending across the opposite end of the entire playing field, without the player kicking or otherwise directly touching the movable target mascot.

The projectiles can be rubber dodge balls, disks, soft rubber balls, hacky sacks, hacky balls, etc. that must not be injurious to players if inadvertently hit. From a play point of view, one ideal projectile is a sand filled hacky ball since it is safe and has significant mass. It also rolls and would not significantly impede the motion of the mascot target when on the ground. For more fast action games, bounceable dodge balls can be utilized as the projectiles thrown toward the movable mascot target toward the designated goal finish line.

The target is a mascot shape atop a platform that rolls on 3-5 swivel casters. If the mascot is tall and basically slender, a hit toward the top will have a great turning moment tending to topple it. To counter this, the platform is internally weighted to provide a low center of gravity. If using such a mascot and toppling is a problem, a penalty against the toppling team can be written into the rules! A low mascot with inherently low center of gravity and therefore low turning moment avoids the toppling problem and does not require a weighted base. The mascot itself can be as simple as a rigid cylindrical form with a mascot poster adhered to its surface. A more fun inspiring mascot would be a rigid blow molded form painted in school colors and with all details represented. A variety of plastic resins from PVC to polycarbonate can be used as required to meet longevity and first cost goals.

A number of different rules can be used to play the game. A game win can be simply the first barrier penetration. A longer game would result if a number of penetrations are required, such as the first five wins. In a school setting with timed periods, perhaps a timed game would be more appropriate. Obviously these variations do not require any additional hardware. To introduce more exercise, buckets full of projectiles (such as hacky balls or dodge balls) can be placed behind the players several feet away toward the back on the floor. A rule change restricting a single ball be carried by a player to the firing line would insure some active hustling back and forth to the buckets and stooping to grab a ball since the number of shots thrown as well as accuracy determine the amount of movement of the mascot; this change would burn a few more calories per game.

In a further alternate embodiment, game such as modeled after football can be used with a set of rules encompassing a particular sports rules and playing field markings. For example, the movable mascot target can be depicted as a football player shaped movable mascot. Optionally, the alternate embodiment can include positional swiveling of the football shaped movable mascot. In a further alternate embodiment, the game can be provided with two opposing teams of multiple movable mascot targets, with sideline yardage markers and cross-field yardage marker lines.

BRIEF DESCRIPTION OF THE DRAWINGS

The present invention can best be understood in connection with the accompanying drawings. It is noted that the invention is not limited to the precise embodiments shown in the following drawings, in which:

FIG. 5 is a perspective view of a hacky ball to be used as a projectile.

FIG. 6 is a side elevation of a tall mascot mounted on a base.

FIG. 7 is an exploded view showing a different tall mascot, mounting pole, ballast weight, base, caster brackets, and casters.

DETAILED DESCRIPTION OF THE DRAWINGS

The number of players on a team can vary but is generally thought to be between 3 to 10 players. The number can be a function of the space allocated to the game on the gym floor.

Figure 1:
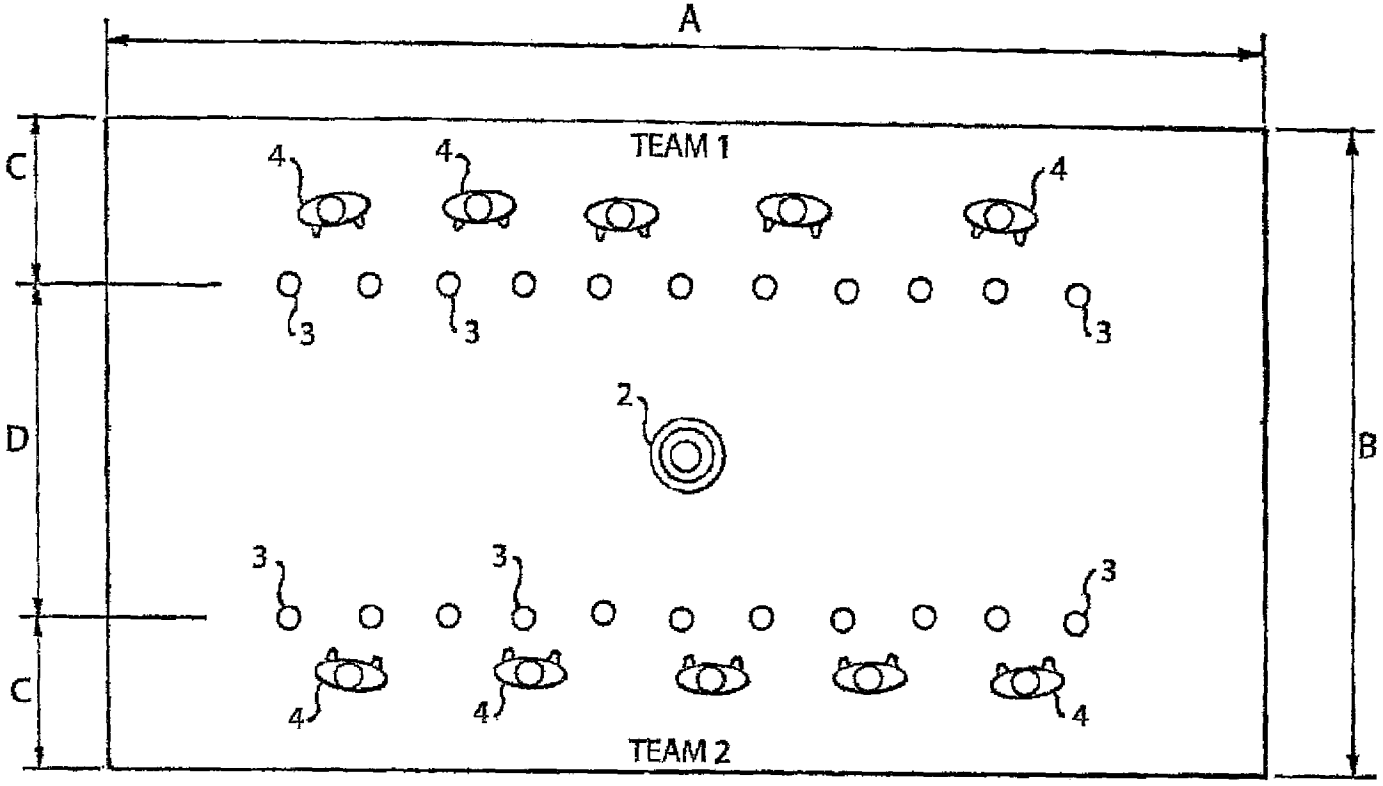
FIG. 1 is a plan view of a gym floor play area for the game of this invention.
Figure 2:
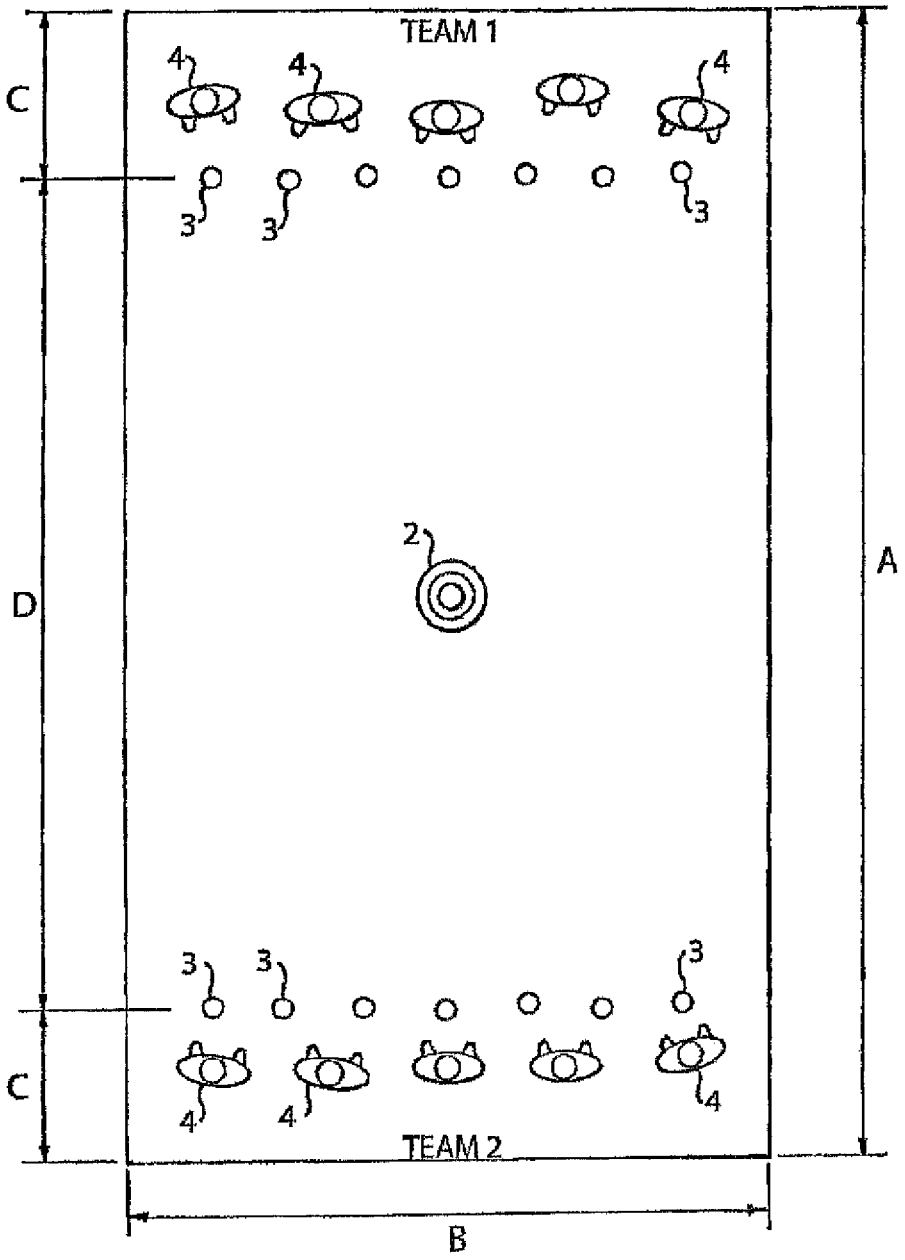
FIG. 2 is another plan view of a gym floor play area using the space differently.

FIGS. 1 and 2 are two layouts of the same rectangular space but used differently. The space incidentally is modeled on an elementary school basketball court where A=74' and B=42', but this could vary. The target location 2 is shown at the center of the region. Traffic cones 3 define the barriers that the mascot must penetrate. The players 4 are shown behind the barrier lines. If we assume using a basketball court space, the team spaces C are 10 feet deep and the distance from barrier to barrier is D which is 22' in FIG. 1 and a whopping 54' in FIG. 2. The speed of the game is somewhat related to distance D although game rules, strength of players, weight of projectiles, such as dodge balls or hacky balls, mass of target, and friction of casters also enter into the equation. Since all are within control of game designers, workable parameters can be found.

Figure 3:
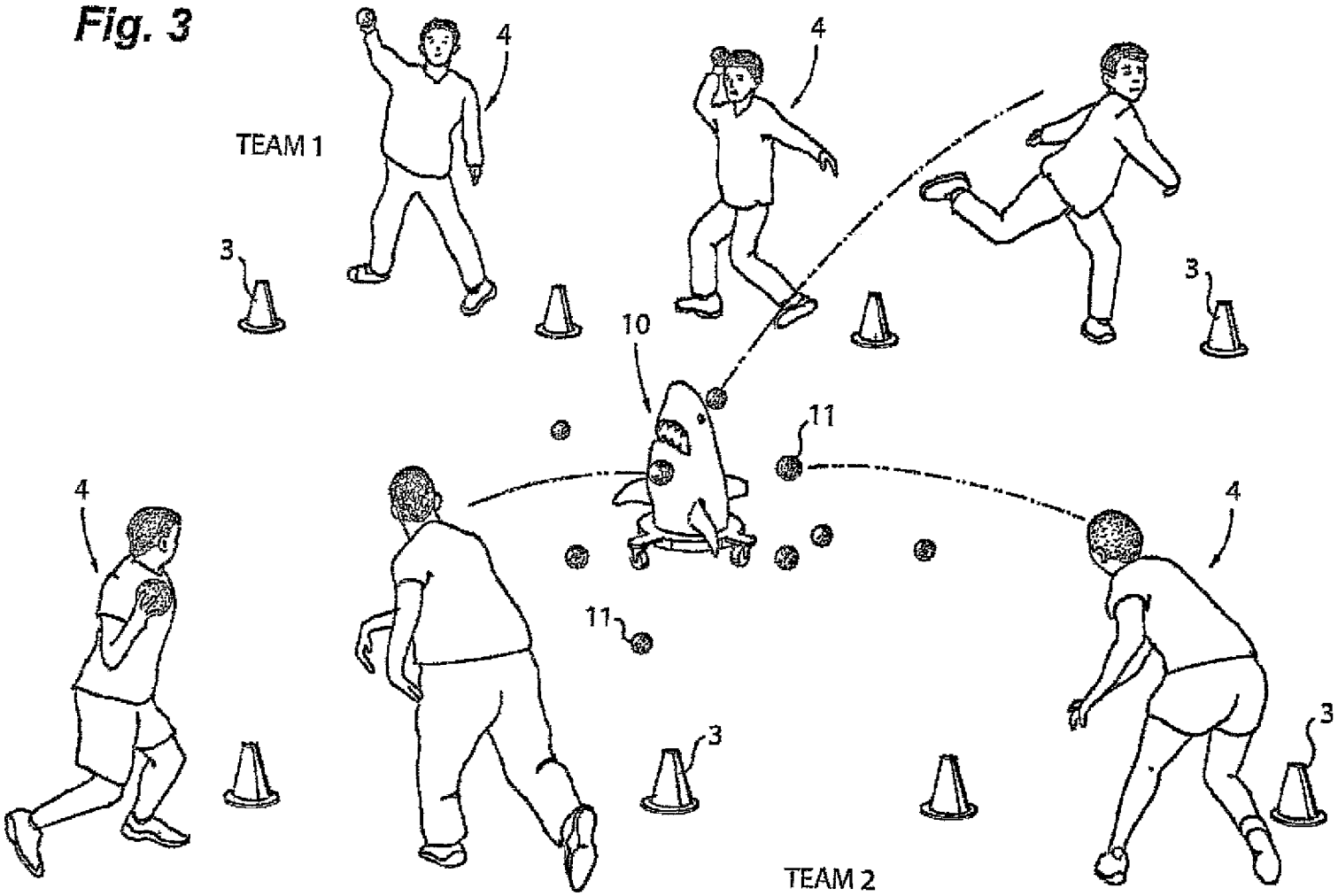
FIG. 3 is a perspective view of an action snapshot of a "Shark Attack" game in progress.
Figure 4:
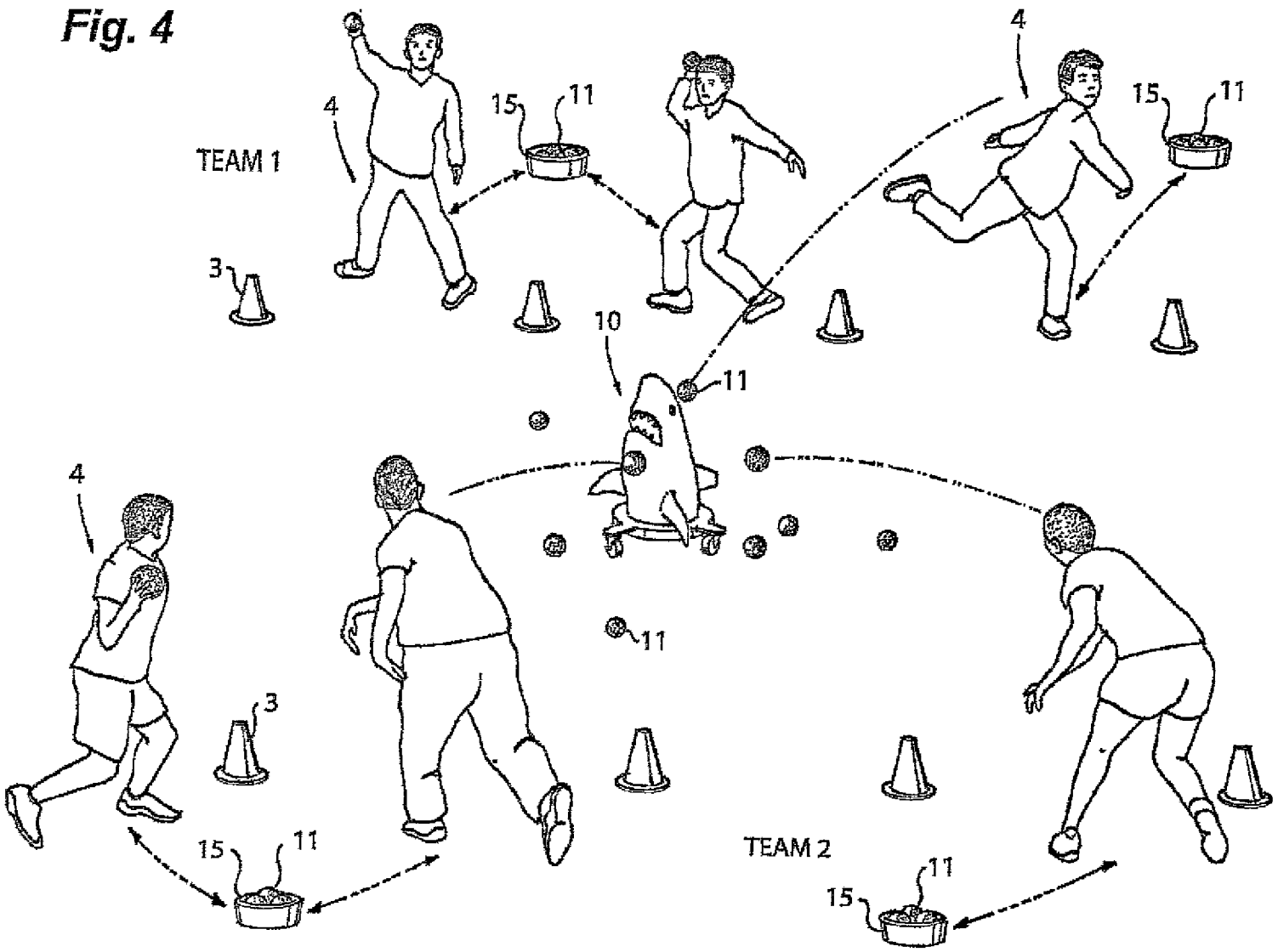
FIG. 4 is similar to FIG. 3 but with remote projectile buckets introduced to the game.

FIG. 3 shows a typical "Shark Attack" game in progress. A shark mascot target 10 is shown being pummeled by hacky balls 11 thrown by players 4 from both sides. FIG. 4 shows the Shark Attack game as modified by the addition of hacky sack buckets 15 with dashed lines with arrows at each end indicating trips to obtain one ball at a time from buckets 15.

Figure 3A:
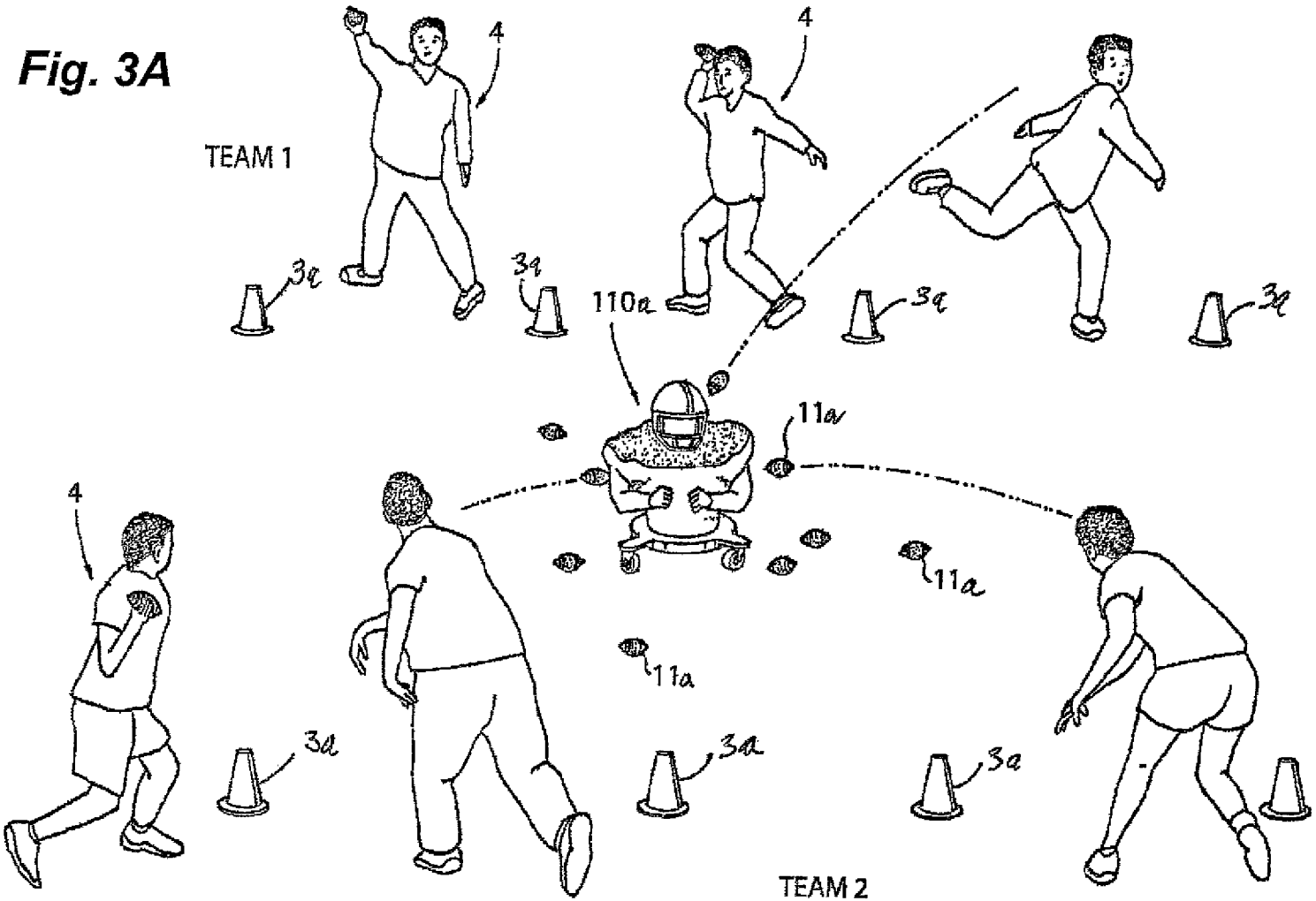
FIG. 3A is a perspective view of an action snapshot of the game in progress, with a different shaped movable mascot, shown as a football shaped movable mascot.

FIG. 3A shows a typical game in progress. A football player shaped mascot target 110*a* is shown being pummeled by balls 11 a thrown by players 4 from both sides.

Figure 3B:
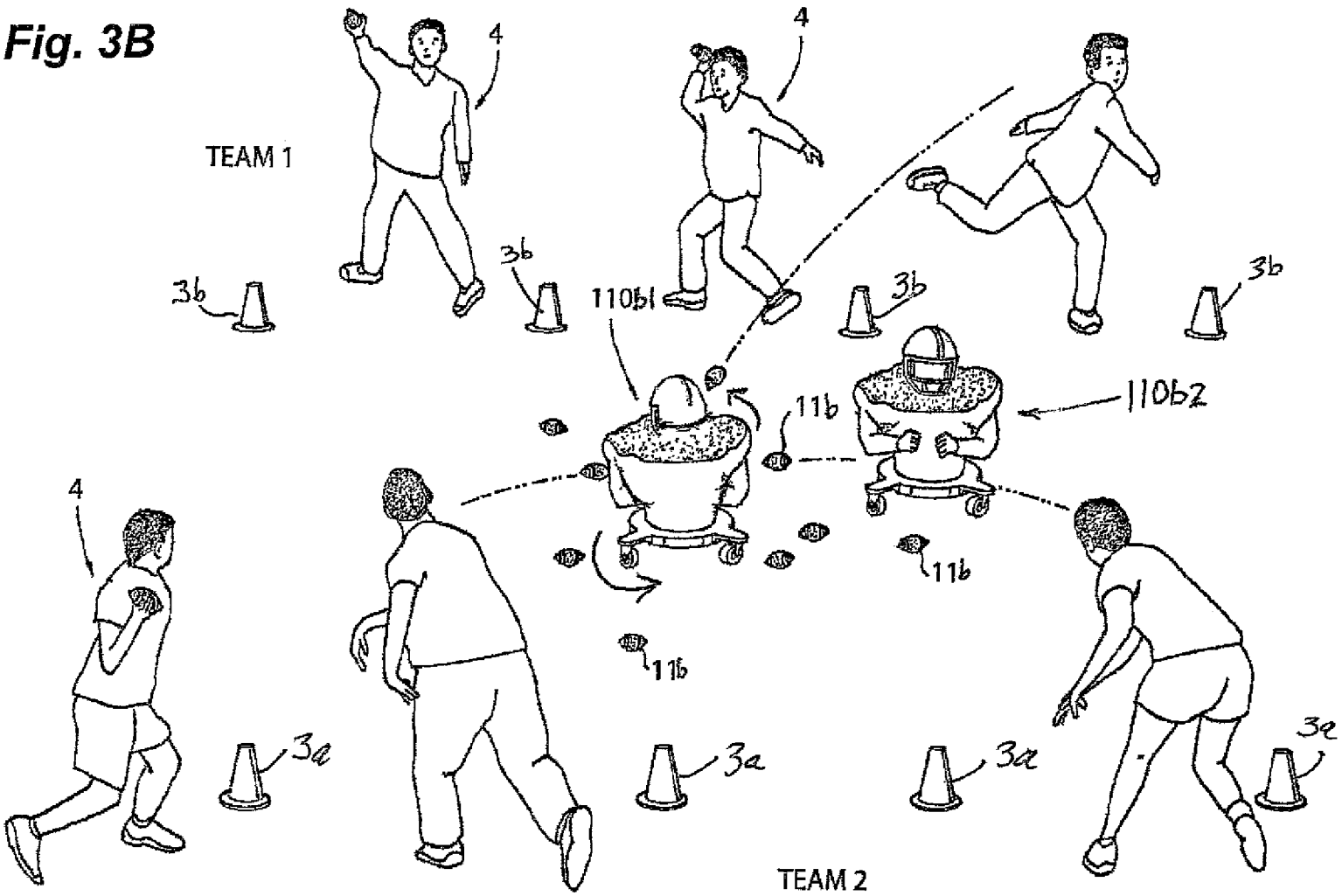
FIG. 3B is a perspective view of an action snapshot of an alternate embodiment with a pair of two football shaped movable mascots of FIG. 3A.

FIG. 3B shows a typical game in progress of an alternate embodiment with a pair of football player shaped movable target mascots 110*b*1 and 110*b*2, each associated with an opposite team of players 4 on opposite sides of the gymnasium playing field floor or other outdoor surface. In the version of the game shown in FIG. 3B, each team of players tries to advance its own mascot 110*b*1 or 110*b*2, before the other mascot 110*b*1 or 110*b*2 crosses the respective finish line associated at the opposite side of the playing field surface. In FIG. 3B Team 1 in the background throws projectiles 11*b* at its movable target mascot 110*b*2, to try and move it past the finish goal line formed by traffic cones or other markers 3*a*, shown in the foreground of FIG. 3B. Likewise, Team 2 in the foreground of FIG. 3B throws projectiles 11*b* at its respective movable target mascot 110*b*1, to try and move it past the other finish goal line formed by traffic cones or other markers 3*b*, shown in the background of FIG. 3B. The game can end when the first mascot 110*b*1 or 110*b*2 crosses the finish line first, before the other player 110*b*1 or 110*b*2 does. Optionally, a time clock can be used, so that designated points are given whenever a player 110*b*1 or 110*b*2 crosses its respective goal finishing line, and that a time clock with a fixed time, such as, for example 30 minutes, is assigned to the duration of the game.

Other optional rules associated with the method shown in FIG. 3B could be that the positionally swiveled football shaped mascot target 110*b*1 or 110*b*2 is optionally swiveled so that the mascot 110*b*1 or 110*b*2 can only cross the finish line formed by the traffic cones 3*a* in a forward faced position, such as shown in the swiveled position of FIG. 3B, with the back of the mascot 110*b*1 facing the Team 2 in the foreground of FIG. 3B. If the mascot 110*b*1 is close to the finish line formed by traffic cone 3*b*, the opposing Team 1 can try and reverse swivel the mascot 110*b*1 by strategically throwing projectiles at the mascot 110*b*1, so that the mascot 110*b*1 is not facing the designated goal line as required. In that case, the opposite team 2 would have to try to further swivel mascot 110*b*1 until mascot 110*b*1 is in a forward facing position, facing toward the finish goal line formed by traffic cones 3*b*, before Team 2 can further attempt to advance its own respective the mascot 110*b*2 past the designated finish goal line formed by traffic cones 3*b*.

Figure 3C:
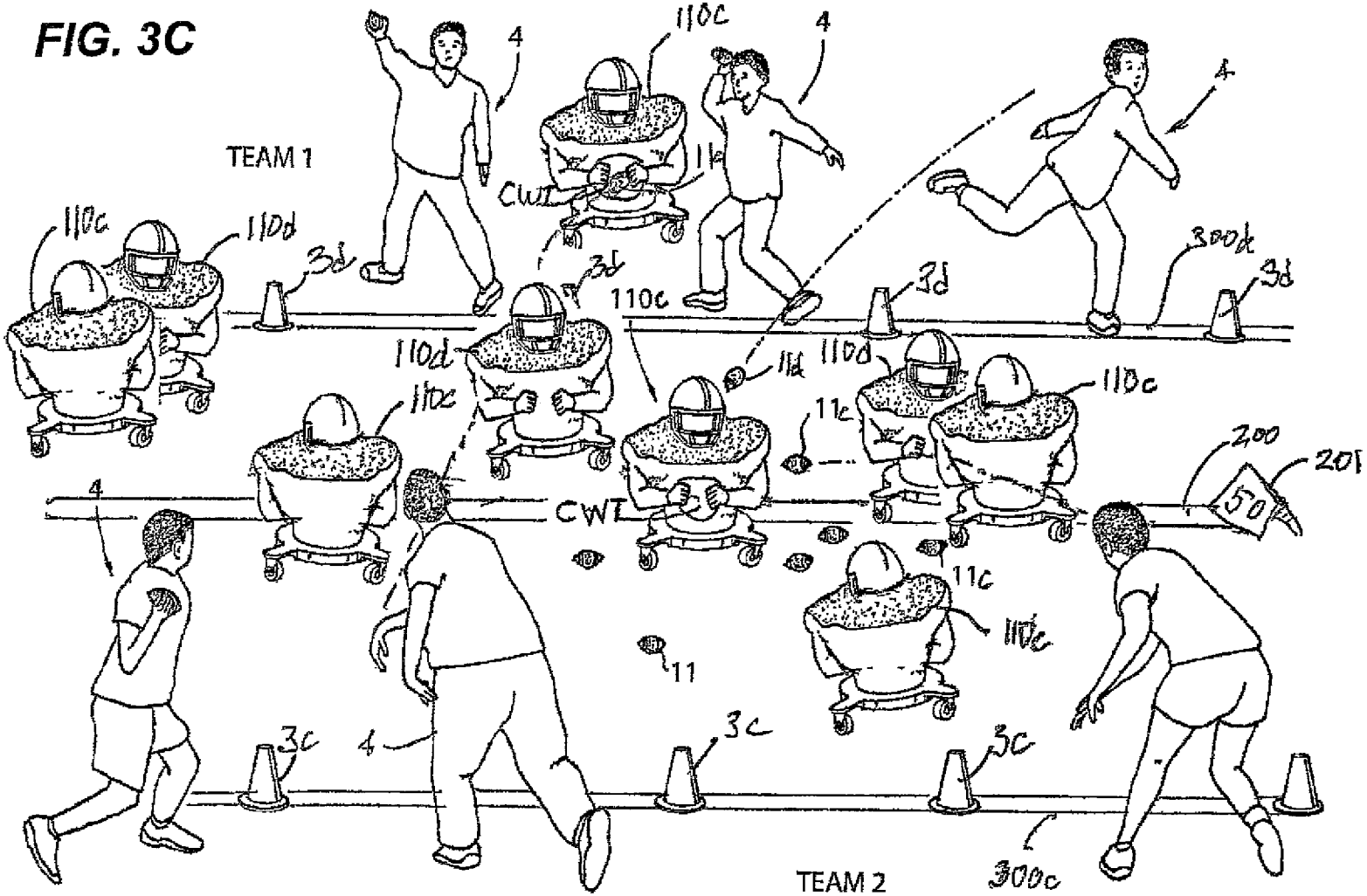
FIG. 3C is an action snapshot of s further alternate embodiment with two teams of multiple movable mascots of FIGS. 3A and/or 3B, with sideline yardage markers and cross-field yardage marker lines.

FIG. 3C is an action snapshot of a further alternate embodiment with two teams of multiple movable mascots of FIGS. 3A and/or 3B, with sideline yardage markers 201 and cross-field yardage marker lines 200, which can be temporarily assembled by placing small linear sections of masking tape or other marking material across the playing field.

FIG. 3C also shows that the finish goal lines 300*c* (on one team's side of the playing field) and 300*d* (on the opposing team's side of the playing field) are formed by the linear arrangement of the designation marking cones 3*c* or 3*d* respectively, and which can also be shown by placing small linear sections of masking tape or other marking material across the playing field. The yardage lines 200 can include a plurality of yardage lines, at designated intervals, such as analogous to a set of parallel 10 yard yardage lines in a typical football field. Of course, when using a gymnasium floor space as the playing fields, the distance between parallel yardage lines 200 can be varied according to the actual dimensions of the playing field between the two opposite designated goal finishing lines 300*c* and 300*d*.

FIG. 3C shows a two sets of pluralities of movable target mascots 110*c* or 110*d*, where one team plays with movable target mascots 100*c* and the opposite team plays with players 110*d*. In the version of the game shown in FIG. 3C, each team of players tries to advance one or more of its own set of multiple mascots 110*c* or 110*d* before the other mascots 110*c* or 110*d* each cross the respective finish line associated at the opposite side of the playing field surface. In FIG. 3C Team 1 in the background throws projectiles 11*d* at one or more of its movable target mascots 110*d*, to try and move them past the finish goal line formed by traffic cones or other markers 3*c*, shown in the foreground of FIG. 3C. Likewise, Team 2 in the foreground of FIG. 3C throws projectiles 11*c* at one or more of its respective movable target mascots 110*c*, to try and move them past the other finish goal line formed by traffic cones or other markers 3*d*, shown in the background of FIG. 3C. The game can end when the first mascot 110*c* or 110*d* crosses the finish line first, before the other player 110*c* or 110*d* does. Optionally, a time clock can be used, so that designated points are given whenever a player 110*c* or 110*d* crosses its respective goal finishing line, and that a time clock with a fixed time, for example 30 minutes, is assigned to the duration of the game.

In a further alternate embodiment, optional catchment wall targets CWT can be provided in one or more movable target mascots 110*c* or 110*d*, so that in addition to the player participants 4 remotely throwing projectiles 11 against a movable target mascots 110*c* or 110*d*, to move the movable target mascots 100*c* or 110*d* toward the opposite finishing goal line to record a score, in an alternate embodiment, there could be a requirement that a team of participant players 4 would first have to throw the projectiles 11 at a specific designated player 11*c* with a catchment wall target CWT, so that the front of the movable target mascot 110*c* is facing players 4, with the added requirement that at least one projectile 11 must be strike the catchment wall target CWT of the designated movable target mascot 110 or 11*d*, before the movable target mascot 110*c* or 110*d* can be advanced toward the opposite goal finish line 300*d*, or 300*c* at the opposite ends of the playing field. In other words, besides hitting the respective mascots 110*c* or 110*d* anywhere on its outer surface, in this alternate embodiment, a higher level of skill could be provided in that the players remotely throwing the projectiles 11*c* or 11*d* at the one or more mascots 110*c* or 110*d* would also have to hit the smaller target area within the confines of catchment wall target CWT, for extra points.

FIG. 3C also shows other football related gestures, such as moving movable target mascots 110*d* in a defensive position against movable mascot targets 110*c* in an offensive advanceable position, such as, for example, either like two "guards" or "tackles" going "nose to nose" so to speak, as shown in FIG. 3C to the right of the central designated movable target mascot 110*c*, with or without the catchment well CW. Defensive blocking can also be provided, such as where a team of players 4 advances a player 110*d* to block the forward progress of player 110*c*, as shown in the upper left of drawing FIG. 3C, where one offensive movable target mascot 110*c* is acting like a running back or wide receiver, and the opposite blocking defensive movable target mascot 110*d* is a linebacker, trying to stop the forward advancement of the wide receiver or running back version of the movable target mascot 110*c*. In that way, by placing mascot 110*d* in front of moving target mascot 110*c*, mascot 110*d* will block and slow the forward momentum of advancing movable target mascot 11*c* in the vicinity of blocking mascot target 110*d*.

Likewise, as shown in the lower right position of the playing field a movable target mascot 110*c* can be strategically placed near the goal line 300*c*, in case there is an equivalent movement of a defensive player 110*d* advancing analogous to having recovered a fumble or otherwise having changed the offensive or defensive possession of the team with movable target mascots 110*c* to that of the opposite team of movable target mascots 110*d*.

In the version of opposite teams of movable target mascots 110*c* and 110*d*, rules can be promulgated that the players need to be swivelly rotated before being able to be moved and advanced forward toward a designated opposite finishing goal line 300*c* or 300*d*, such as shown in the alternate embodiment with a single movable mascot that must be swivelly rotated as shown in FIG. 3B as aforesaid.

It is further noted that the game shown in FIG. 3C of two opposing sets of movable target mascots 110*c* and 110*d*, can be with as few as only one movable target mascot 110 or 110*d* on each respective team of players 4, so that a score can be achieved if one of the two movable target mascots is moved across the opposite goal finishing line 300*c* or 300*d*, before the opposing movable target mascot 110*c* or 110*d* reaches the respective opposite designated goal finish line 300*c* or 300*d*.

Furthermore, the number of movable target mascots 110*c* and 110*d* can be increased to multiple numbers, such as having four or five movable target mascots 110*c* and 11*d*, shown in FIG. 3C, or more depending upon the size or the playing area and the number of opposing players 4, each associated with an opposite team of movable target mascots 110*c* or 110*d*.

Another alternate embodiment (not shown) could be where the players 4 remotely manually throw projectiles 11*c* or 11*d* of any shape or consistency against one or more movable mascots 110*c* and 110*d*, to advance them toward a designated goal line 200*c* and 300*d*, but where a separate ball, such as a soccer ball is provided, so that the movable target mascots 110*c* and 110*d* have to be moved forward at any angle, with or without swivelly rotating, to advance the soccer ball against the designated goal finish lines 300*c* or 300*d*. In effect, the players 4 remotely and manually throw the projectiles 11, 11*a*, 11*b* or 11*c* against the movable target mascots 110*c* or 110*d*, which in turn, are thrust remotely against the soccer ball, thereby indirectly advancing the soccer ball toward the respective goal finish line 300*c* or 300*d*, all without any of the player participants 4 physically contacting either the movable target mascots 110*c* and 110*d*, or the soccer ball itself, by direct physical contact, such as by kicking or otherwise.

FIG. 4 is similar to FIG. 3 but with remote projectile buckets 15 being provided for storing the projectiles 11 therein, and retrieving them for faster occurrences of remotely thrown projectiles 11.

FIG. 5 is a view of a hacky ball 11. While a variety of projectiles, such as rubber dodge balls, can be used, optionally a sand filled hacky ball can alternatively be a likely candidate for this game. If a different type of ball is used, it alternatively can optionally have a no-bounce characteristic so as not to constantly hit the players or travel to the opposite side of the gym floor. A hacky sack may work as well, but it may impede movement of the target mascot as it would not readily roll out of the way.

FIG. 6 is a side view of a tall mascot 20 assembled into a target 10 by being attached to a base 21 riding on 3-5 casters 23 using brackets 22 for attachment. FIG. 7 shows an exploded view of a different shaped tall mascot 20 with a recess 27 accepting rod 26 which fits through ballast disk 25 and rests inside the central recess in base 21. Five casters 23 with brackets 22 are shown around the periphery. For maximum effect, ballast weight 25 must be mounted very low in base 21. It can be a disk from a dumbbell. Rod 26 and ballast disk 25 are attached to base 21. Mascot 20 can have a friction fit onto rod 26 inside recess 27.

Figure 8:
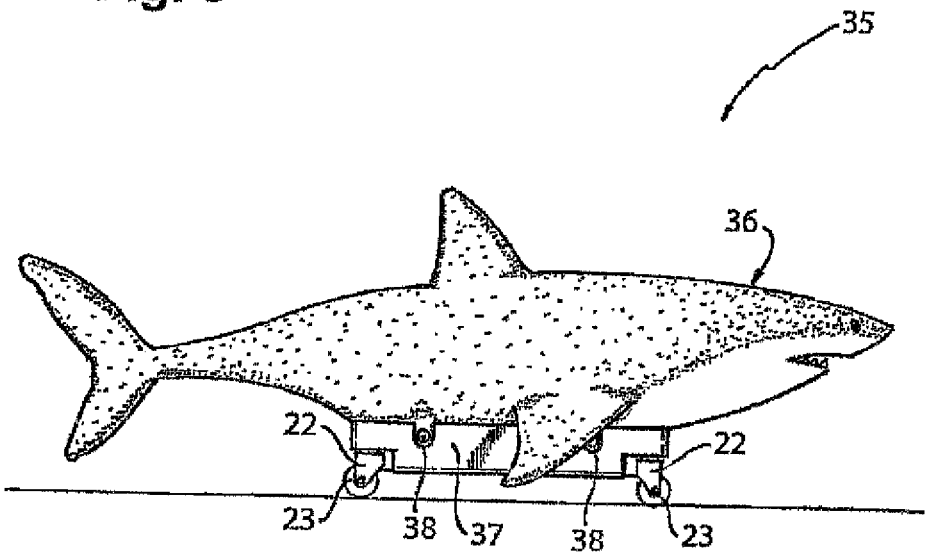
FIG. 8 is a side elevation showing a low mascot on a base as a functioning target.
Figure 9:
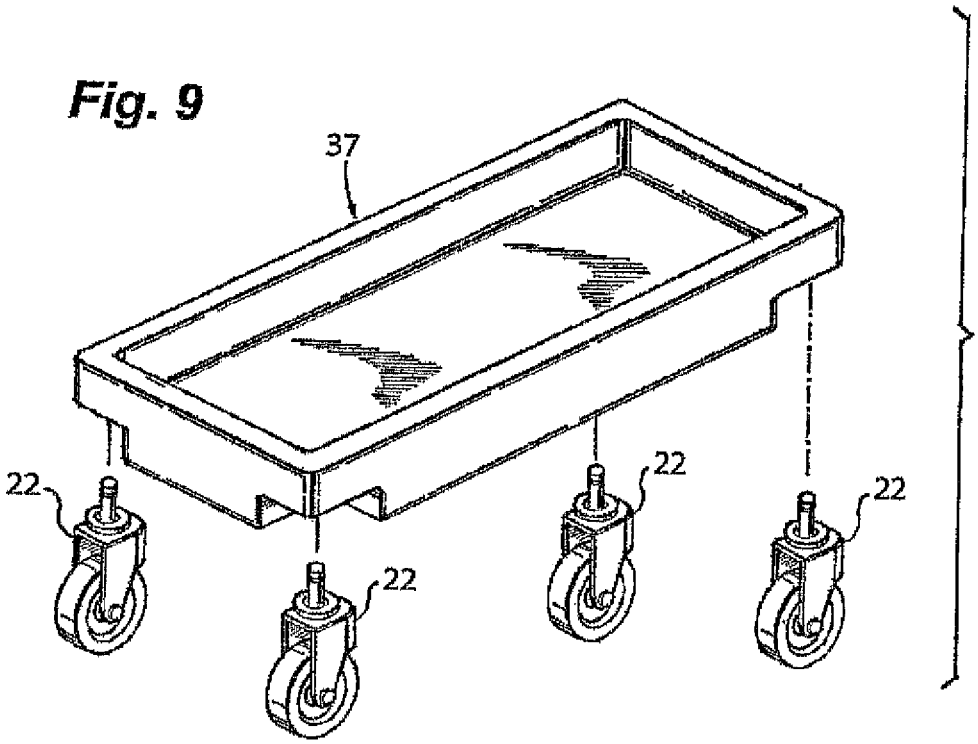
FIG. 9 is a top plan exploded view of a base for a low mascot showing its simplicity.

FIGS. 8 and 9 relate to a low mascot. Mascot shape 36 is attached to base 37 via side tabs 38. Exploded view of FIG. 9 shows the simplicity of base 37 which just has four outboard caster brackets 22. The center area of frame 37 could be open. Weight ballast can be added to base 37 if required. Note that the outboard location of casters 23 increases the effective width of target 35 which enhances its resistance to toppling when hit.

In summary, the method of playing a game of the present invention includes providing the following:

a) one or more movable target components in the shape of a mascot mounted on swivel casters rollable upon a playing field, b) using projectiles thrown at the one or more mascots by two opposing teams from geometrically opposite sides of the playing field to move one or more of the movable target mascots forward on the playing field, c) whereby members of the player teams manually throw by hand the projectiles at the one or more movable target mascots from behind designated goal finish lines, each designated goal finish line extending a substantial length of the playing field on opposite sides of the playing field, whereby further the players manually throw the projectiles from behind the goal finish lines to advance the one or more movable target mascot components toward an opposite designated goal finish line, and d) the one or more movable target mascots are advanced remotely by the players, without direct physical contact of the players against the movable target mascot components, until penetrating one or more times one of the opposite designated goal finish lines for determining a winner of the game, wherein a game win occurs when the one or more movable target mascots penetrates the designated goal finish line on one or more scoring occasions, with or without a designated running time clock having been completed running out time wise over a defined period of time.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A method of playing a game and determining a winner of said game, consisting essentially of the steps of:

placing a movable target mascot component mounted on swivel casters rollable upon a playing field, arranging players of two opposing teams in remote positions behind respective designated goal finishing lines on geometrically opposite sides of the playing field, and said remotely positioned players manually throwing projectiles at said movable target mascot component from behind said respective designated goal finish lines, to contact and thereby force said movable target mascot component to advance toward an opposite respective designated goal finish line, wherein each designated goal finish line extends a substantial length of the playing field, on opposite sides of the playing field, wherein said movable target mascot component is advanceable by contact by the manually thrown projectiles until said movable target mascot component penetrates one of said respective opposite designated goal finish lines thereby determining a winner of said game, and wherein said movable target mascot component is advanced by said opposing team players, remotely positioned behind said respective designated opposite goal finish lines, manually throwing the projectiles at said movable target mascot component, said projectiles being in physical contact with said movable target mascot component, and without direct physical contact by said opposing team players.

2. The method as in claim 1, wherein the goal finish lines are designated by temporary placement of traffic cones.

3. The method as in claim 1, wherein the playing field encompasses a rectangular area of about 74 feet by 42 feet.

4. The method as in claim 1, wherein a central starting point location of said movable target mascot component is at a center between said respective goal finish lines.

5. The method as in claim 1, wherein the projectiles are selected from the group consisting of rubber dodge balls, disks, soft rubber balls, hacky sacks and hacky balls.

6. The method as in claim 5, including the step providing buckets of the projectiles placed behind said remotely positioned players.

7. The method as in claim 5, wherein the projectiles are dodge balls.

8. The method as in claim 5, wherein the projectiles are soft, sand filled hacky balls.

9. The method as in claim 1, wherein said movable target mascot component is mounted atop a platform that rolls on swivel casters, wherein if said movable target mascot component is tall and slender, a hit toward the top thereof effects a great turning moment tending to topple said movable target mascot component, wherein in an effort to counter this tendency to topple when hit toward the top, the platform is internally weighted to provide a low center of gravity.

10. The method as in claim 9, wherein said movable target mascot component is a rigid cylindrical form with a mascot poster adhered to its surface.

11. The method as in claim 9, wherein said movable target mascot component is a rigid blow molded form painted in school colors and with character details represented therewith.

12. The method as in claim 9, wherein said movable target mascot component is attached to the platform using brackets for attachment.

13. The method as in claim 9, wherein said movable target mascot component has a recess adapted for accepting a rod which fits through a ballast disk and rests inside a central recess in the internally weighted platform.

14. The method as in claim 13, wherein said movable target mascot component has a friction fit onto said rod inside said recess.

15. The method as in claim 9, wherein said movable target mascot component is vertically oriented and supported upon said swivel casters.

16. The method as in claim 1, wherein said movable target mascot component has an inherently low center of gravity and therefore a low turning moment with a tendency to topple, and does not require a weighted base.

17. The method as in claim 1 in which said movable target mascot component is configured to swivel on said swivel casters between the forward facing and back positions but can only cross said respective designated goal finish line while in the forward facing position, such that the opposing team can try and reverse swivel said movable target mascot component to not face said respective designated goal line as required.

18. A method of playing a game on a playing field with geometrically opposing sides by opposing teams of players, the method comprising:

arranging the players of each of the opposing teams of players behind each of opposing goal finish lines arranged at each of respective geometrically opposing sides of the playing field, deploying, for each team, at least one respective movable target mascot component mounted on swivel casters to enable said movable target mascot component to swivel from a front-facing to a rear-facing position, and back, and to roll upon the playing field, opposing team players throwing projectiles at the team's respective at least one movable target mascot component from behind each respective team's respective opposite goal finish line at the geometrically opposing sides of the playing field to move said respective at least one movable target mascot components on the playing field, wherein each team's respective goal finish line extends a substantial length of the playing field on the geometrically opposing sides of the playing field, wherein opposing team players manually throw the projectiles from behind the each opposing team's respective opposite goal finish line to advance each team's at least one movable target mascot component toward an opposite respective designated goal finish line, wherein each of said respective at least one movable target mascot components of each team are advanceable until penetrating one of the respective opposite designated goal finish lines thereby determining a winner of the game, wherein each team's respective at least one movable target mascot component is advanced without direct physical contact by the team's players until one of said respective at least one movable target mascot components is advanceable by thrown projectiles to penetrate the team's the opposite respective designated goal finish line for determining said winner of the game.

19. The method as in claim 18, further comprising providing said opposing teams each with sideline yardage markers and cross-field yardage marker lines, such that upon said at least one movable target mascot component penetrating said respective designated goal finish line on one or more scoring occasions, the winner of the game is determined, with or without a designated running time clock having been completed running out time wise and wherein said least one scoring occasion is a plurality of scoring occasions playable over a defined period of time.

* * * * *